US006340287B1

(12) United States Patent
Eino

(10) Patent No.: US 6,340,287 B1
(45) **Date of Patent: *Jan. 22, 2002**

(54) MULTISTAGE CENTRIFUGAL COMPRESSOR IMPELLER FOR MULTISTAGE CENTRIFUGAL COMPRESSOR AND METHOD FOR PRODUCING THE SAME

(75) Inventor: Takashi Eino, Tsuchiura (JP)

(73) Assignee: Hitachi, Ltd., Tokyo (JP)

( * ) Notice: This patent issued on a continued prosecution application filed under 37 CFR 1.53(d), and is subject to the twenty year patent term provisions of 35 U.S.C. 154(a)(2).

Subject to any disclaimer, the term of this patent is extended or adjusted under 35 U.S.C. 154(b) by 0 days.

(21) Appl. No.: 08/597,995

(22) Filed: Feb. 7, 1996

(30) Foreign Application Priority Data

Mar. 20, 1995 (JP) ..... 7-060369

(51) Int. Cl.[7] ..... F04D 29/44
(52) U.S. Cl. ..... 415/199.1; 415/199.2
(58) Field of Search ..... 415/199.1, 199.2, 415/198.1, 199.3; 416/175, 198 R, 203

(56) References Cited

U.S. PATENT DOCUMENTS

| | | | | | |
|---|---|---|---|---|---|
| 1,050,419 | A | * | 1/1913 | Banner | 415/199.2 |
| 2,108,786 | A | * | 2/1938 | Bigelow et al. | 415/199.1 |
| 2,142,596 | A | * | 1/1939 | Algarsson | 415/199.1 |
| 2,604,257 | A | * | 7/1952 | Church et al. | 415/199.1 |
| 2,970,750 | A | * | 2/1961 | Swearingen | 415/199.3 |
| 3,105,632 | A | * | 10/1963 | Tanzberger | 415/199.1 |
| 3,143,103 | A | * | 8/1964 | Zuhn | 415/199.1 |
| 3,664,001 | A | * | 5/1972 | Pilarczyk | 415/199.1 |
| 3,927,763 | A | * | 12/1975 | Strub et al. | 415/199.2 |
| 4,224,010 | A | * | 9/1980 | Fujino | 415/199.2 |
| 4,322,200 | A | | 3/1982 | Stiegelmeier | |
| 4,579,509 | A | * | 4/1986 | Jacobi | 415/199.1 |
| 4,775,270 | A | | 10/1988 | Katayama et al. | |
| 4,887,940 | A | * | 12/1989 | Todoroki et al. | 415/199.1 |
| 4,938,661 | A | * | 7/1990 | Kobayashi et al. | 415/199.1 |
| 4,961,260 | A | * | 10/1990 | Ferri et al. | 415/199.1 |
| 5,062,766 | A | * | 11/1991 | Miura et al. | 415/199.1 |

FOREIGN PATENT DOCUMENTS

| | | | | |
|---|---|---|---|---|
| FR | 2419415 | | 10/1979 | |
| FR | 2419416 | | 10/1979 | |
| JP | 6034593 | | 9/1985 | |
| JP | 2-161200 | * | 6/1990 | |
| JP | 3-151597 | * | 6/1991 | |
| SU | 1225924 | * | 4/1986 | 415/199.2 |

OTHER PUBLICATIONS

Patent Abstracts of Japan vol. 14, No. 416 (M–1021) & JP A–02–161200 (Hitachi) abstract.

Patent Abstracts of Japan vol. 15, No. 378 (M–1161) & JP A–03–151597 (Fij Electric) abstract.

* cited by examiner

*Primary Examiner*—John Kwon
(74) *Attorney, Agent, or Firm*—Antonelli, Terry, Stout & Kraus, LLP

(57) ABSTRACT

By changing a vane height to produce different vanes from master vanes, different impellers are produced, and therefore there can be obtained an inexpensive and high-reliability multistage centrifugal compressor and an impellers therefor. An impeller for multistage centrifugal compressor, which is to be mounted on a rotary shaft, comprises a plurality of vanes disposed between a disk and a shroud and separated from one another equiangularly. By changing the vanes of the impeller only in height without changing the configuration, vanes can be obtained, and then a different impeller comprising the disk, a shroud and vanes is also obtained. Since a whole of the vane has a configuration identical to a part of the vane, these vane can be produced by a single pair of the pressing dies.

3 Claims, 6 Drawing Sheets

MULTISTAGE CENTRIFUGAL COMPRESSOR IMPELLER FOR MULTISTAGE CENTRIFUGAL COMPRESSOR AND METHOD FOR PRODUCING THE SAME

BACKGROUND OF THE INVENTION

The present invention relates to a multistage centrifugal compressor used in petrochemistry plants and process equipment of general industry, and more particularly to a centrifugal impeller constituting each stage of such multistage centrifugal compressor and a method for producing the same.

The impeller used in the multistage centrifugal compressor comprises two rotary discs (a disk and a shroud), and a plurality of vanes disposed between the disk and the shroud and substantially equidistantly in a circumferential direction to define passages by means of the disk and the shroud and the vanes. The disk, the shroud and the vanes are so designed and manufactured as to provide a proper velocity distribution of a working gas for every stage.

Further, the suction temperature and the suction pressure of the impeller vary for each stage because the fluid to be employed is a gas with compressibility.

As a result, the density of the gas varies in the stages, and the desired width of the gas passage of the impeller, that is, the vane height, is made narrower as going downstream(a suction port, a first stage, a second stage, . . . ), and therefore the impellers of the respective stages need to be different in configuration from each other.

Consequently, the multistage centrifugal compressor is heretofore produced in such a manner that a suitable configuration of the impeller has been decided for every stage and the disk and the shroud have been manufactured separately by machining in accordance with the decided configuration of the disk and the shroud of the impeller of each stage. The vanes have been shaped into the required configuration by press working and integrated into the disk and the shroud by means of welding or the like.

Meanwhile, there has been employed another method in which a simple shape of a vane, such as a two-dimensional vane, is substituted for the optimum shape of the vane for every stage, and then such simple shaped vane is made by casting or the like. Moreover, there has been known still another method in which a multispindle NC machine tool is used to make the vane of a complicated shape for a half-shrouded impeller with no shroud.

In the various methods described above, it is necessary that the impellers of the respective stages are so designed and manufactured as to be different in configuration from each other. These methods for producing an impeller for centrifugal compressor are disclosed in Japanese Patent Unexamined Publication Nos. 2-161200 and 3-151597.

In the former, a shroud is made axially movable for the purpose of suppressing occurrence of surging to obtain a high-efficiency impeller. However, there is given no consideration for the reduction of the number of manufacturing steps in producing the impeller, such as employment of a process of the impeller common to a plurality of stages.

On the other hand, in the latter, the width of the passage at an outlet of the impeller is adjustable for the purpose of regulating the flow rate to enhance the efficiency. However, there is also given no consideration for the reduction of the number of manufacturing steps, such as employment of a process and a design common to a plurality of impellers.

According to both of these conventional technologies, the impeller has been designed and manufactured for every stage, and no consideration has been given for the reduction of the number of required processing steps in order to manufacture an impeller for a centrifugal compressor at low cost.

SUMMARY OF THE INVENTION

It is an object of the present invention to provide an inexpensive multistage centrifugal compressor, an inexpensive impeller for a multistage centrifugal compressor and a method for producing an inexpensive impeller, without the above-described problems of the prior art.

It is another object of the invention to employ a production process of the impeller common to the stages of the multistage centrifugal, in which the impellers had to be conventionally designed and manufactured individually for the respective stages due to the compressibility of a gas.

It is still another object of the invention to be able to employ a common NC program or a common pressing die which is to be used in manufacturing the impeller for a multistage centrifugal compressor.

It is a further object of the invention to provide a high-efficiency multistage centrifugal compressor free from the reduction in performance of the multistage centrifugal compressor, a high-efficiency impeller for a centrifugal compressor and a method for producing such a high-efficiency impeller, while achieving the above objects.

It is a still further object of the invention to provide a high-reliability impeller for multistage centrifugal compressor and a method for producing the same by simplifying the production process.

To these ends, according to one aspect of the present invention, there is provided a multistage centrifugal compressor comprising: a plurality of impellers mounted on a rotary shaft apart from one another, each of the impellers including a disk, a shroud and a plurality of vanes disposed between the disk and the shroud and separated from one another in a circumferential direction; and a casing for housing these impellers, the casing being formed with a suction port and a discharge port, a gas drawn into through the suction port being compressed in sequence by the rotation of the impeller of every stage and discharged from the discharge port, wherein a whole of the vane of one of at least two impellers has a configuration identical to a part of the vane of the other impeller.

Preferably the one impeller is provided in a stage more remote from the suction port of the multistage centrifugal compressor than the other impeller is.

It is also preferable that the one impeller is provided in a stage disposed downstream of the gas flow in the multistage centrifugal compressor than the other impeller is.

According to another aspect of the present invention, there is also provided a multistage centrifugal compressor in which centrifugal compressors are connected in multiple stages through piping, each of which comprises: a rotary shaft; an impeller including a disk fixed to the rotary shaft, a shroud fixed to the rotary shaft, and a plurality of vanes disposed between the disk and the shroud and separated from one another in a circumferential direction; and a casing housing the impeller and having a suction port through which a gas is drawn in and a discharge port from which the compressed gas is discharged, wherein the vane of one of the impellers of at least two stages of centrifugal compressors has a configuration identical with a part of a vane of the other of the impellers of at least two stages.

Preferably an intercooler is disposed between the respective stages of centrifugal compressors.

It is preferred that the one impeller is disposed downstream of the other impeller with respect to a gas passage formed within the multistage centrifugal compressor made up of the connected centrifugal compressors.

In still another aspect of the invention, a centrifugal impeller is used in either of the above-described multistage centrifugal compressors.

Further, there is provided an impeller for a multistage centrifugal compressor comprising: a disk; a shroud; and a plurality of vanes disposed between the disk and the shroud and separated from one another in a circumferential direction, wherein the vane is made up of a group of linear line segments each extending from a disk-side edge to a shroud-side edge, the linear line segments of the group being changed in length individually. Further, the corresponding two linear line segments of adjacent impellers are different in length from each other so as to form different vanes for plural stages of the multistage centrifugal compressor.

It is preferred that an NC machine tool is used to manufacture this kind of vane.

In another aspect of the invention, there is provided a method for producing an impeller for a multistage centrifugal compressor comprising a disk, a shroud and a plurality of vanes disposed between the disk and the shroud and separated from one another in a circumferential direction, the method comprising the steps of: preparing a plurality of sets of flat vane blanks, the flat vane blanks in one set formed in a meridional cross-section surface shape different from the flat vane blanks in another set; pressing these blanks by means of the same press dies to form the vanes of different configurations; and attaching the vanes of each of the sets to the disk and the shroud to produce impellers for different stages, respectively.

According to the present invention, the vanes constituting the different impellers of the multistage centrifugal compressor can be formed by partially cutting off and press forming the same vane blanks. Namely, only a single kind of vane blank (master vane blank) is needed for the different vanes. More specifically, the vanes comprise three-dimensional complicatedly-undulating surfaces. The vane which is formed by press forming a whole master vane blank is used in an impeller for a first stage. The vane which is formed by press forming a master vane blank partially cut off (or almost the whole master vane blank) is used in an impeller for a second stage. The vane which is formed by press forming a master vane blank further partially cut off (or a substantial part of the master vane blank) is used in an impeller for a third stage. Namely, in an impeller for a later stage, a smaller part of the master vane blank is used to form a vane. Accordingly, only by putting between two press dies the vane blank which is defined by partially cutting the master vane blank off and has an area required for the vane of the impeller of the stage, the vanes of every stage can be easily produced.

Meanwhile, in case of production by an NC machine, it is necessary to change only the coordinates of the shroud wall surface and the disk wall surface. The coordinates between the shroud and the disk are common to every stage, and therefore the program can be used in common.

Further, it is not always necessary that the master vane blank is used for all the stages. The master vane blank may be changed every two stages, for example a first master vane blank for the first and the second stages and a second master vane blank for the third and the fourth stages. Also the master vane blank may be used merely for the first and the second stages and different vane blanks may be used for the respective stages other than the first and the second stages.

DESCRIPTION OF THE PREFERRED EMBODIMENTS

Figure 1:
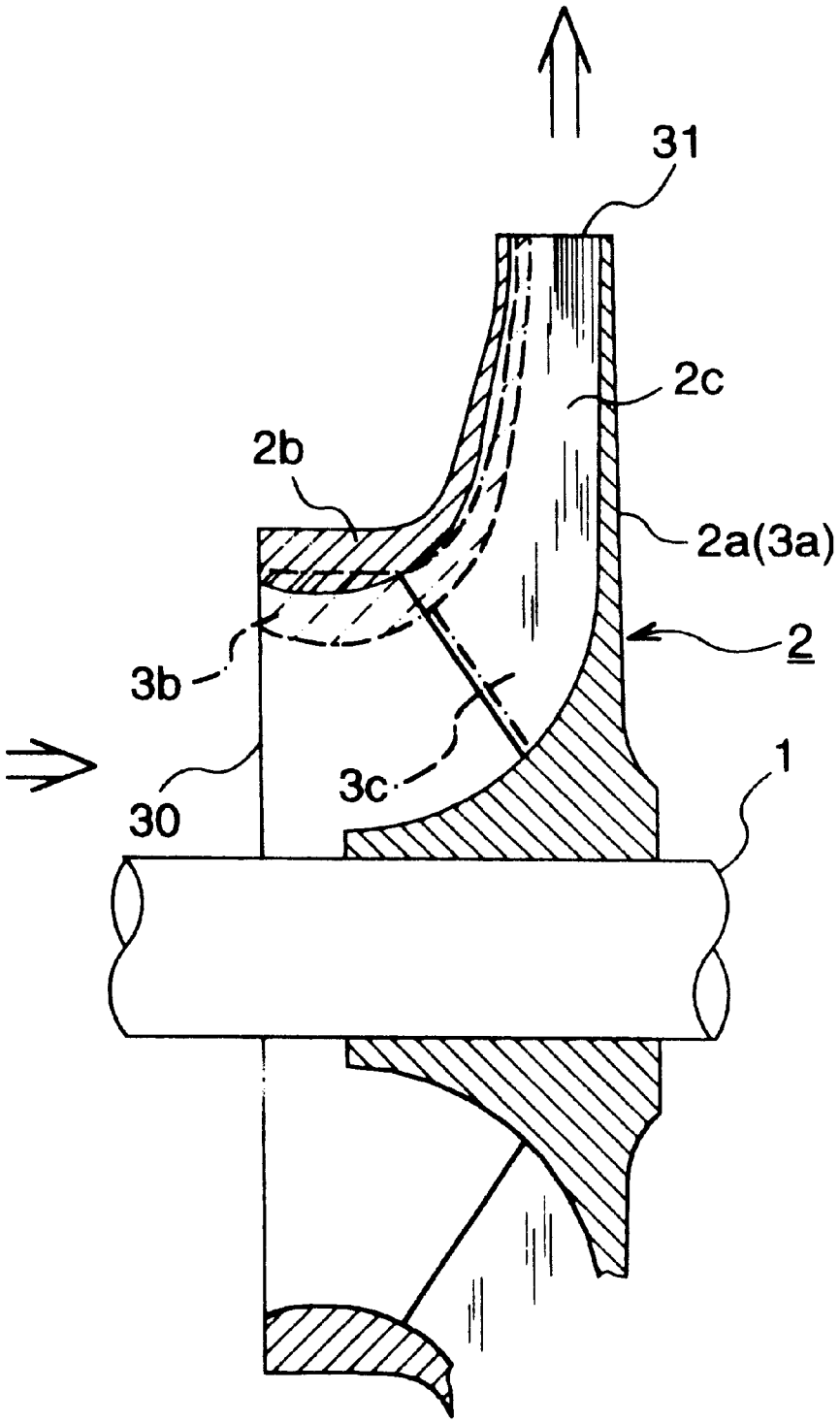
FIG. 1 is a fragmentary sectional view of an impeller for multistage centrifugal compressor according to an embodiment of the present invention.
Figure 2:
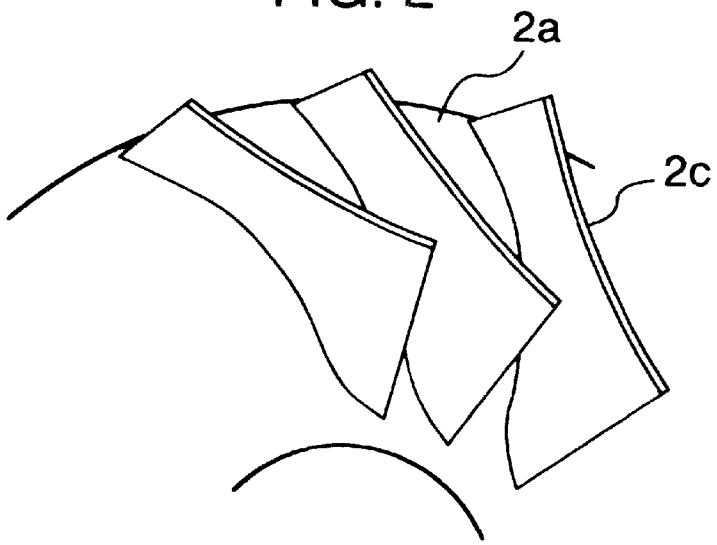
FIG. 2 is a perspective view of FIG. 1 with a shroud omitted.

A preferred embodiment of the present invention will be described below with reference to the drawings. As shown in FIG. 1, an impeller 2 fixedly mounted onto a rotary shaft 1 has a disk 2*a* and a shroud 2*b*. Between the disk and the shroud a plurality of vanes 2*c* are arranged at substantially equal pitches in the circumferential direction, each of the vanes having a three-dimensional configuration as shown in FIG. 2.

In the centrifugal compressor, a working gas is drawn in through a suction port 30, and compressed with the rotation of the rotary shaft 1 while passing through the passage defined by the disk 2*a*, the shroud 2*b* and the vanes 2*c*, and then discharged from a discharge port 31 at the upper part of FIG. 1.

In manufacturing the impeller having the above construction, if the vane is made by means of press working, a pair of pressing dies, which are different in configuration from the desired vane by an amount corresponding to the plastic deformation thereof, are made by casting or machining. A disk plate, which is pre-shaped into a meridional surface shape, is put into and pressed by such pressing dies to form a desired meridional surface shape.

Since the flow rate of gas varies for every stages due to its compressibility, it is impossible to simply use the similarity principle in designing each stage unlike a hydraulic machine. It has therefore been necessary for each stage to design a detailed configuration of the impeller after obtaining the principal specification data of the impeller based on the gas suction and discharge conditions of the impeller, rotational speed and so on. For this reason, many pairs of pressing dies corresponding to the number of stages are needed to be prepared for producing the multistage centrifugal compressor.

In the present invention, the vanes 2*c* and 3*c* of the impellers of two different stages of the multistage centrifugal compressor are different in the shape of the meridional surface from each other, but they are partially identical in the configuration to each other as shown in FIG. 1.

For example, if the first-stage impeller of the multistage centrifugal compressor has a longitudinal sectional form as shown by solid line in FIG. 1, the configuration of the second-stage impeller, disposed downstream of the first-stage impeller, has a longitudinal sectional form as shown by chain line in FIG. 1. It is noted that a vane 3*c* of the second-stage impeller is partially identical with the vane 2*c* of the first-stage impeller, namely the vane 3*c* is perfectly identical with a part of the vane 2*c*, while a shroud 3*b* of the second-stage impeller is different from the shroud 2*b* of the first-stage impeller. Incidentally, a disk 3*a* of the second-stage impeller is identical with the disk 2*a* of the first-stage impeller. In consequence, the vane 2*c* and the vane 3*c* can be made of vane blanks each of which is to be finished in the meridional surface of the corresponding vane by means of a single pair of pressing dies.

As apparent from the above, common pair of pressing dies can be used, and therefore the production cost and the number of manufacturing steps of the vane can be reduced. In this embodiment, the common pair of pressing dies is used for the vanes for the first-stage and second-stage impellers, but this invention is not exclusively for this combination. A common pair of pressing dies may be used for all of vanes for every stage, or may be used for vanes of every two adjacent stages, without departing from the scope or spirit of the invention.

The flow states at the inlet ports of the impellers, the vane of each of which impellers is different from each other as shown in FIG. 1, will be described hereinafter by referring to FIG. 3.

Figure 3:
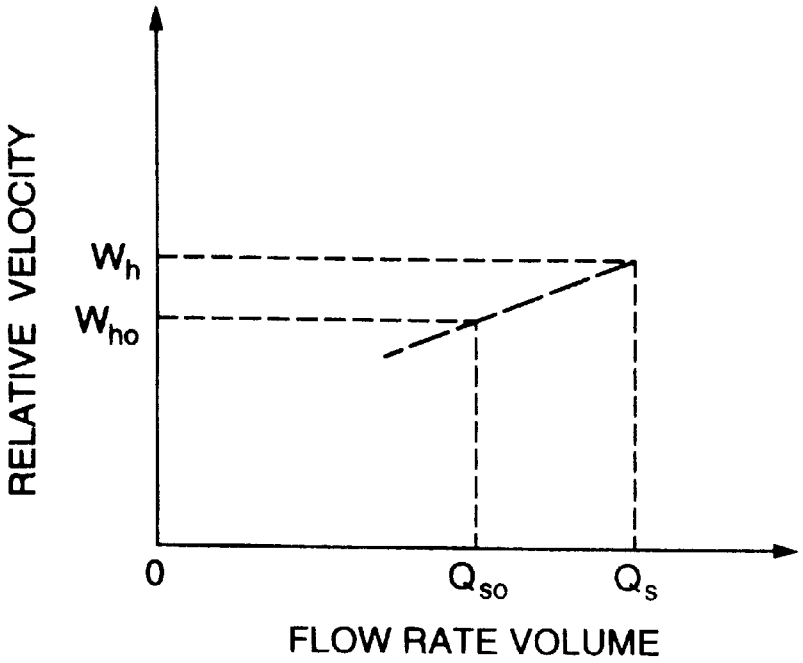
FIG. 3 is a graph for explaining the flow condition when the vane height is changed.

FIG. 3 shows the relationship between the suction flow rate (volume flow rate) of the impeller and the local relative velocity at the impeller inlet port. The local relative velocity means the difference in vector between the absolute velocity of the gas flowing into the impeller and the rotational speed.

It is assumed that the inlet local relative velocity of the impeller 2, comprising the disk 2*a*, the shroud 2*b* and the vanes 2*c*, is Wh when the suction flow rate of the impeller 2 is $Q_s$. Meanwhile, concerning the impeller 3 made by modifying the impeller 2 only in the vane height, namely comprising the disk 3*a*, the shroud 3*b* and the vanes 3*c*, the flow rate is changed from $Q_s$ to $Q_{so}$ and the inlet local relative velocity is reduced from $W_h$ to $W_{ho}$.

In the impeller with the vanes of reduced height, as compared with the original impeller, the inlet local relative velocity is decreased and as a result the flow loss is also decreased, which is proportional to the n-th (n>1) power of the gas flow velocity. This means that if the impeller 2 comprising the disk 2*a*, the shroud 2*b* and the vanes 2*c* is manufactured in an optimum design, and an impeller of downstream stage, in which the flow rate is smaller than that of the impeller 2, is designed and produced so as to become the impeller in which the vane height is reduced by an amount correspondingly to a decrement in the flow rate, there can be obtained the downstream impeller free from a drastic reduction in efficiency. In other words, the difference of the vane of the downstream stage from the optimum vane can be minimized.

As is clear from the above, it is more advisable that the vane, whose meridional surface is largest among the vanes made by the common pair of pressing dies, is optimally designed, as compared with the case when the vane, whose meridional surface is smaller, is optimally designed.

Figure 4:
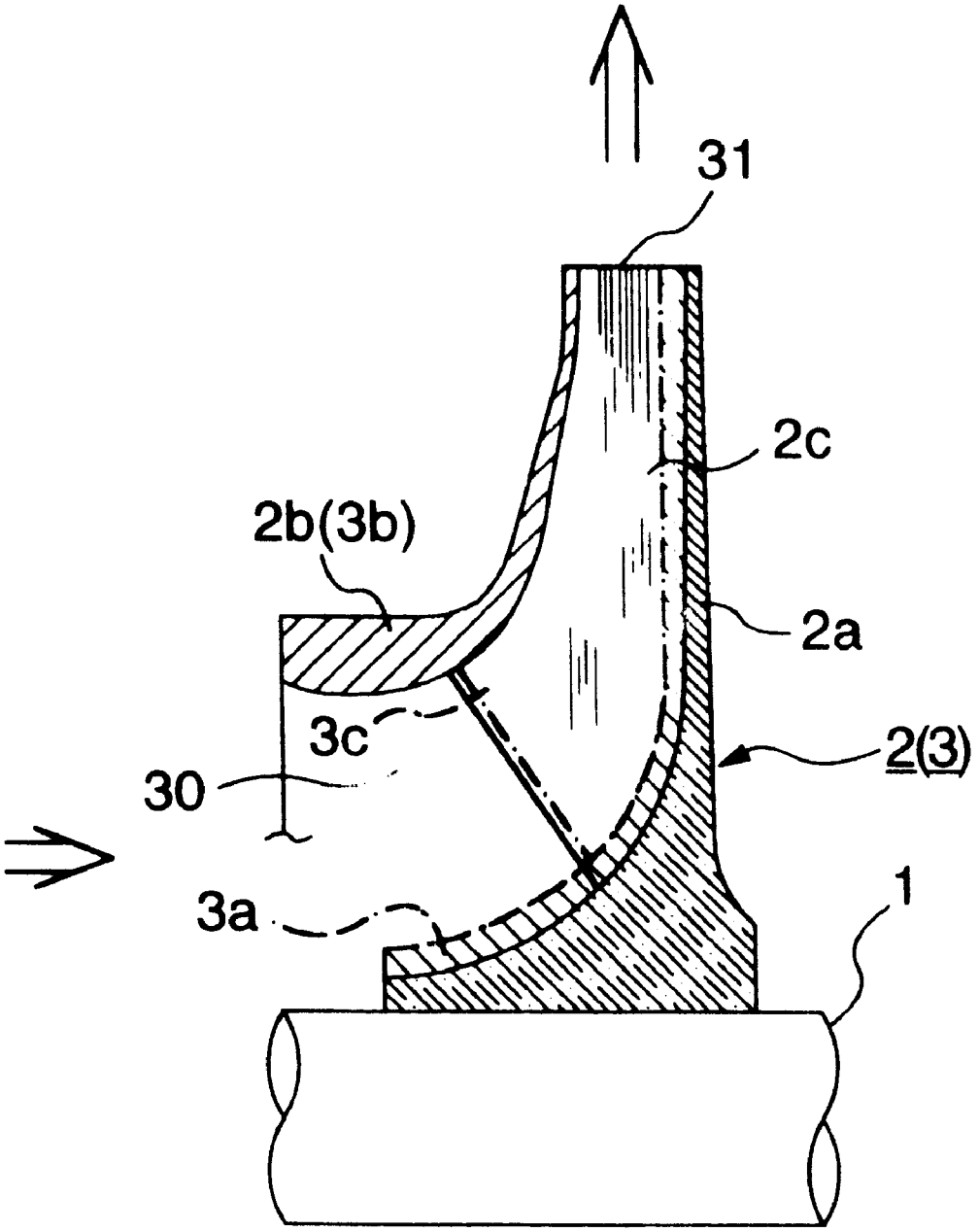
FIG. 4 is a fragmentary sectional view of an impeller for multistage centrifugal compressor according to another embodiment of the invention.
Figure 5:
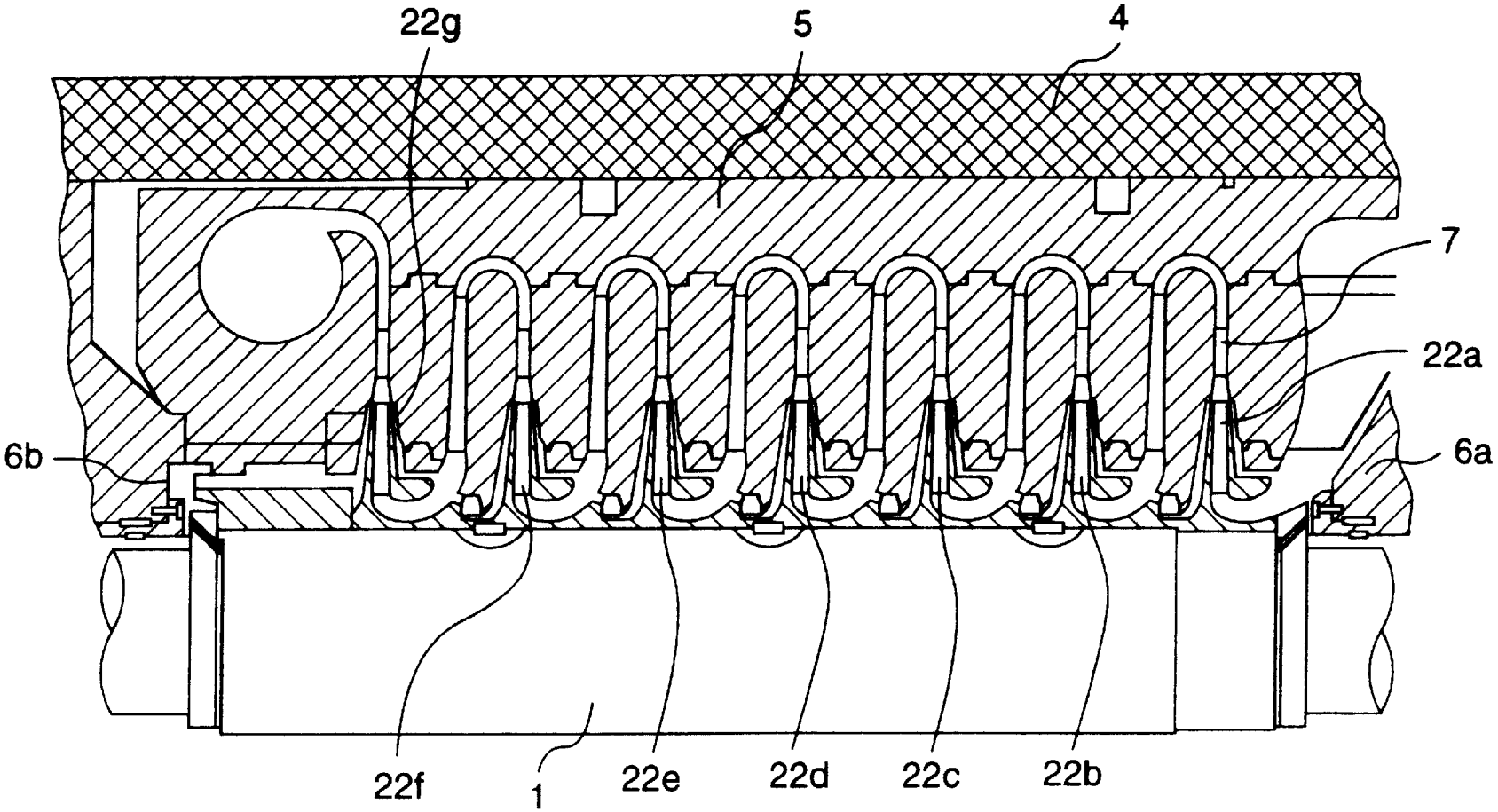
FIG. 5 is a longitudinal sectional view of a multistage centrifugal compressor according to an embodiment of the invention.

Another embodiment of the invention is shown in FIG. 4. This embodiment differs from the embodiment of FIG. 1 in the point that the height of the vane of the impellers, made by the common pair of pressing dies, is changed on the disk side. More specifically, the shroud 2*b* of the impeller 2 is identical with the shroud 3*b* of the impeller 3. However, though the vane 2*c* of the impeller 2 is different at the disk side from the vane 3*c* of the impeller 3, the vane 2*c* is identical at the shroud side with the vane 3*c*. In other words, a whole vane 2*c* is identical with a part of the vane 3*c*. Consequently the disk 2*a* of the impeller 2 is different from the disk 3*a* of the impeller 3. With such construction, in the case of mounting a plurality of impellers 22*a*–22*g* onto a one rotary shaft 1 as a single spindle multistage centrifugal compressor shown in FIG. 5, the diameter of the rotary shaft can be made larger and then the rigidity of the rotating system can be enhanced. In FIG. 5, a static passage is defined by a suction end cover 6*a*, a discharge end cover 6*b*, a casing 4, an inner casing 5, and a diffuser/diaphragm 7.

In the single spindle multistage compressor, a working gas is drawn in through a suction port formed in a portion of the casing located upstream of the suction end cover 6*a*. The pressure of the gas is increased in sequence as the gas passes through the passages formed between the impellers 22*a*–22*g* of every stage and the diffuser/diaphragm 7, so that the flow rate of the gas at the inlet of the impeller of every stage is reduced in sequence. Accordingly, by using the above-described impeller for the impeller of every stage, there can be obtained a high-reliability multistage centrifugal compressor at low cost.

Figure 6:
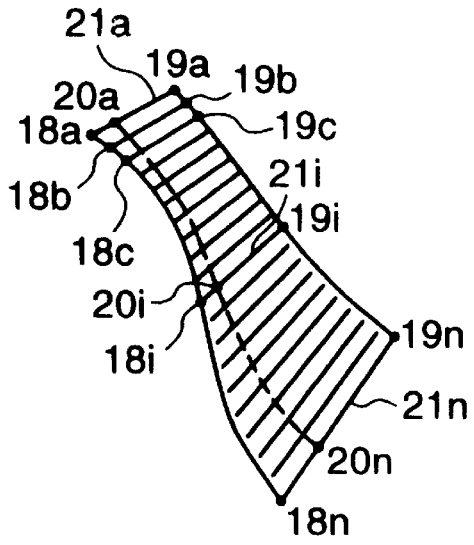
FIG. 6 is a perspective view of vanes which are to be used in the impeller for multistage centrifugal compressor of the present invention.

In still another embodiment of the invention, as shown in FIG. 6, the vane 2*c* has a three-dimensional shape made up of linear segments 21*a*, 21*b*, . . . , 21*n* connecting end points 18*a*, 18*b*, . . . , 18*n* on the shroud side to end points 19*a*, 19*b*, . . . , 19*n* on the disk side, respectively.

This kind of vane can be easily manufactured by controlling an end milling machine so as to move an axis thereof along each linear element. If the end milling machine is once programmed to manufacture the vane 2*c* made up of the linear segments 21*a*, 21*b*, . . . , 21 under the above-mentioned control based on a stored program, such program can be also applied for manufacturing the vane 3*c* whose height is changed or reduced and which has a three-dimensional shape made up of linear segments connecting end points 20*a*, 20*b*, . . . , 20*n* on the shroud side to end points 19*a*, 19*b*, . . . , 19*n* on the disk side, respectively. Therefore, the manufacture of the different vanes can be facilitated and the number of processing steps can be reduced.

Figure 7:
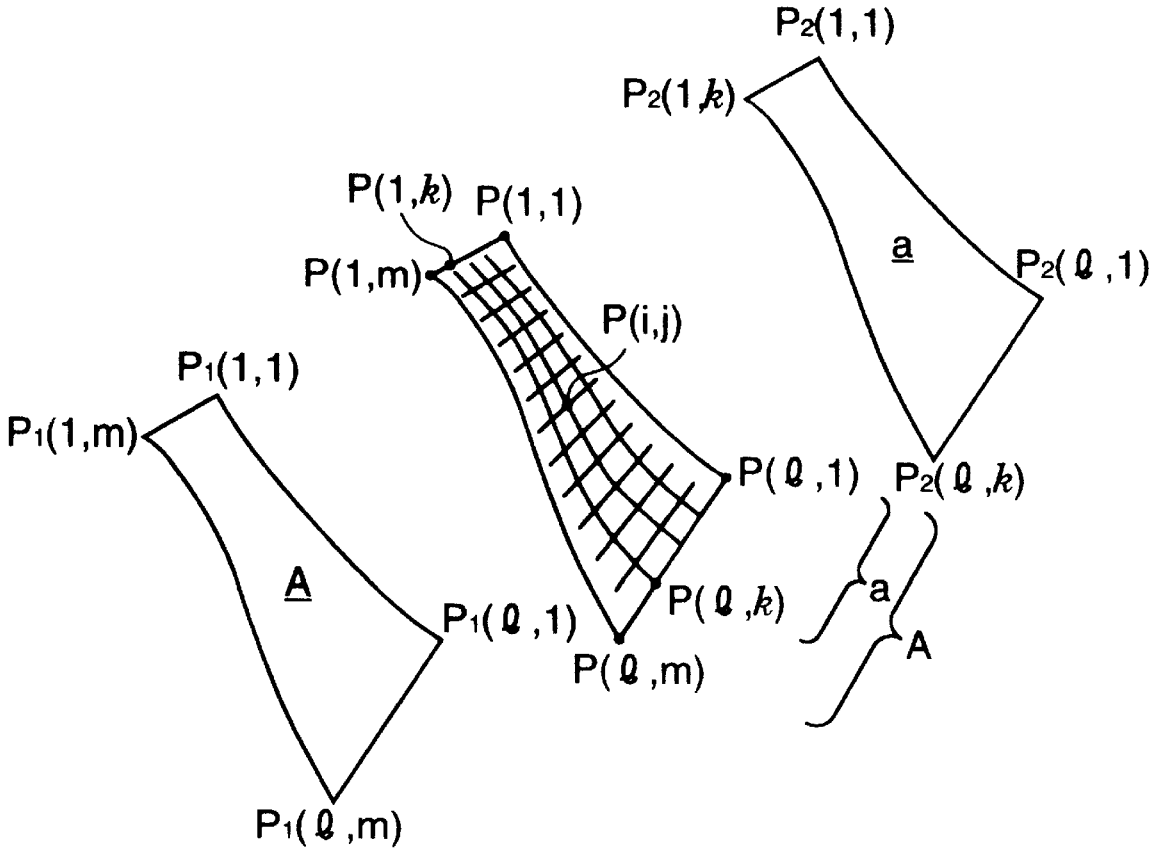
FIG. 7 is a perspective view of vanes to be used in another impeller for multistage centrifugal compressor of the invention.

In the above embodiment, the vane is represented by a plurality of the linear segments. In the embodiment shown in FIG. 7, the vane is represented by a group of points. When a vane A is represented by a group $P_1$ of points $\{P_1 (i,j): i=1, \ldots, l; j=1, \ldots, m\}$, and a vane a whose height is smaller than that of the vane A is represented by a group P2 of points $\{P_2 (i, j): i=1, \ldots, l; j=1, \ldots, k (k<m)\}$, the common portion or overlapped portion $\{P (i, j): i=1, \ldots, l; j=1, \ldots, k\}$ of the two vanes A and a may be obtained by the same process (program). In connection with the vane A, only the remainder portion $\{P (i, j): i=1, \ldots, l; j=k, \ldots, m\}$ of the vane A is obtained by another process (program). Therefore, it is possible to reduce the number of processing steps as well as the cost due to the reduced steps of the total program.

For the above programmed process, a multiple spindle NC milling machine is most convenient, but the present invention is not limited to such a machine but various kinds of numerically-controllable machine tools are also applicable.

Further, while the above description has made reference only to the manufacture of the vane, it goes without saying that the same technical skill can be used in the case where the vanes and the shroud, or the vanes and the disk are machined as one body. In such a case, by welding the disk to a machined product in which the vanes and the shroud are integrated with each other, or the shroud to a machined product in which the vanes and the disk are integrated with each other, a desired impeller can be produced at a low price.

Figure 8:
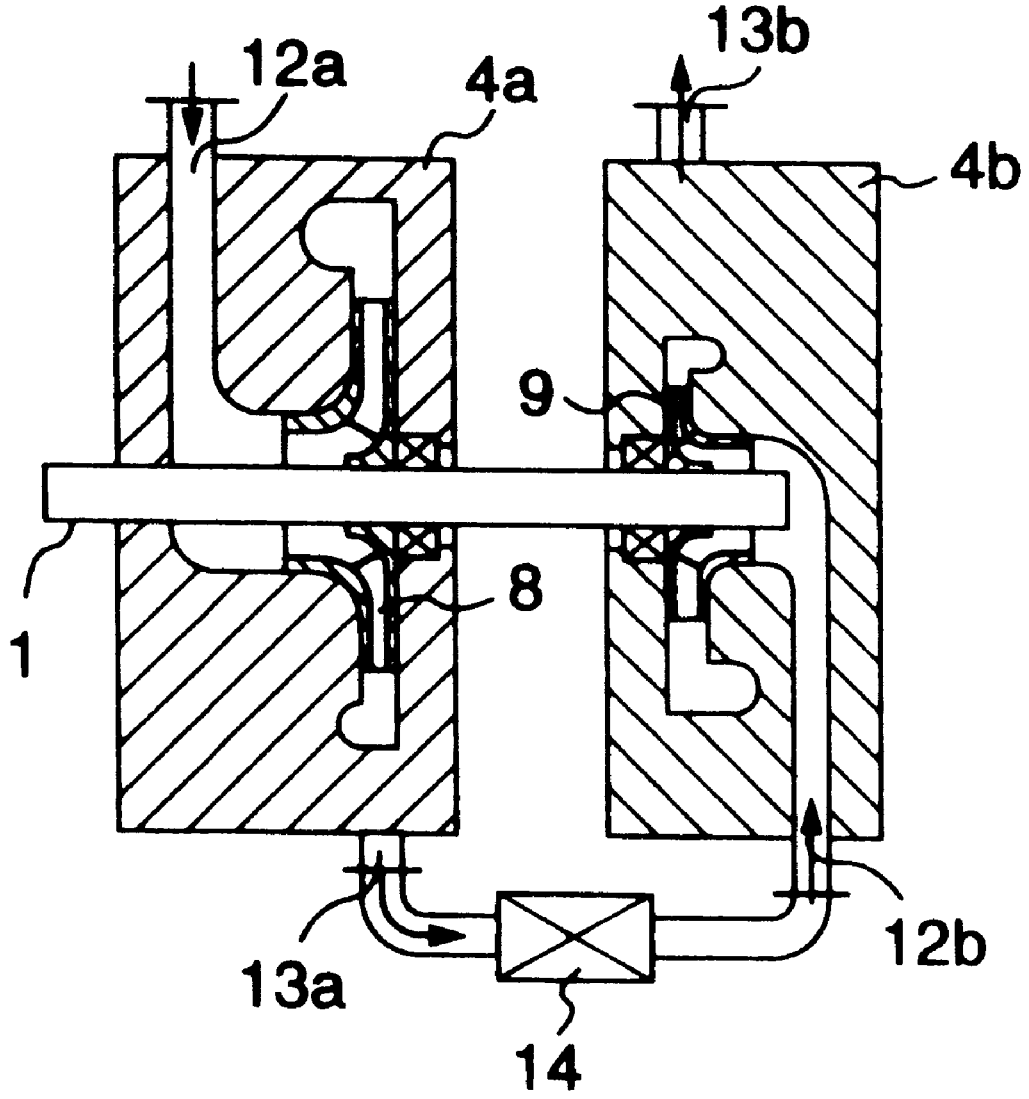
FIG. 8 is a sectional view of a multistage centrifugal compressor according to another embodiment of the invention.

In a further embodiment shown in FIG. 8, impellers 8 and 9 mounted on opposite end portions of a rotary shaft 1 are housed within casings 4*a* and 4*b*, respectively. The casing 4*a* is formed with a suction port 12*a* and a discharge port 13*a*, while the casing 4*b* is formed with a suction port 12*b* and a discharge port 3*b*.

The discharge port 13*a* is connected to the suction port 12*b* through an intercooler 14. Even in a ultistage centrifugal compressor of the type that single-stage centrifugal compressors are connected together by means of the piping as shown in FIG. 8, it is also possible to reduce the number of processing steps and increase the reliability by employing the above-described various kinds of impellers. It is noted that the use of the intercooler enables the multistage centrifugal compressor to be further enhanced in efficiency.

Although the number of stages is two in this embodiment shown in FIG. 8, the invention is not limited to this but can be applied to three stages, four stages, five stages or more. In these cases, the intercooler does not need to be used between every pair of adjacent stages but may be equipped as the occasion demands.

In any of the above-described embodiments, all impellers have the same outer diameter, but it is of course possible that the outer diameter of the impeller of a downstream stage is made smaller.

As has been described above, according to the present invention, the vanes of the impellers for some stages of the multistage centrifugal compressor can be made from a common master vane blank, and therefore the production cost, the number of processing steps and the number of rejects of the product can be reduced, thereby improving the reliability.

Further, the use of a common NC program becomes possible, and therefore an inexpensive and high-reliability multistage centrifugal compressor can be obtained.

Moreover, it is possible to obtain a multistage centrifugal compressor in which the reduction in performance or efficiency can be neglected even if the vanes are made from a common master vane blank.

In addition, the production process is simplified, and therefore it is possible to obtain a high-reliability multistage centrifugal compressor, an impeller therefor and a method of producing the same, which are less liable to cause manufacturing error as or defective manufacturing.

Besides, due to the possibility of application to a plurality of different kinds of machines, there can be obtained a high-reliability impeller for a centrifugal compressor at further reduced cost.

What is claimed is:

1. A multistage centrifugal compressor comprising:

a plurality of impellers mounted on a rotary shaft, each of said impellers including a disk, a shroud and a plurality of vanes of three dimensional shape disposed between said disk and said shroud and separated from one another in a circumferential direction, wherein each of the plurality of vanes of one of said plurality of impellers is smaller than each of the plurality of vanes of another of said plurality of impellers; and a casing for housing said plural impellers, said casing being formed with a suction port and a discharge port, through said suction port a gas is drawn into said compressor, and the gas drawn is compressed in sequence by rotation of each impeller and discharged from said discharge port, wherein a three-dimensional shape of an entire vane of said one of said plurality of impellers is identical to a three-dimensional shape of a portion of each of said plurality of vanes of said another of said plurality of impellers.

2. A multistage centrifugal compressor according to claim 1, wherein said one of said plurality of impellers is disposed more remote from said suction port than said another of said plurality of impellers.

3. A multistage centrifugal compressor according to claim 1, wherein said one of said plurality of impellers is disposed downstream of said another of said plurality of impellers with respect to a gas passage formed within said multistage centrifugal compressor.

* * * * *